US007622680B2

(12) United States Patent
Bricker et al.

(10) Patent No.: US 7,622,680 B2
(45) Date of Patent: Nov. 24, 2009

(54) CABLE JACKET WITH INTERNAL SPLINES

(75) Inventors: Michael Wayne Bricker, Oak Ridge, NC (US); Richard Walter Speer, Kernersville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 793 days.

(21) Appl. No.: 10/659,156

(22) Filed: Sep. 10, 2003

(65) Prior Publication Data

US 2005/0051355 A1 Mar. 10, 2005

(51) Int. Cl.
*H01B 11/02* (2006.01)

(52) U.S. Cl. ..... 174/113 R

(58) Field of Classification Search ..... 174/113 R, 174/113 C, 131 A, 27
See application file for complete search history.

(56) References Cited

U.S. PATENT DOCUMENTS

| | | | | |
|---|---|---|---|---|
| 476,484 | A * | 6/1892 | Patterson | 174/27 |
| 4,777,325 | A | 10/1988 | Siwinski | |
| 4,892,442 | A * | 1/1990 | Shoffner | 405/183.5 |
| 5,132,488 | A * | 7/1992 | Tessier et al. | 174/34 |
| 6,124,551 | A * | 9/2000 | Mattos et al. | 174/113 R |
| 6,248,954 | B1 | 6/2001 | Clark et al. | |
| 6,310,295 | B1 * | 10/2001 | Despard | 174/113 R |
| 6,639,152 | B2 * | 10/2003 | Glew et al. | 174/113 C |
| 2003/0205402 | A1 * | 11/2003 | Koyasu et al. | 174/113 C |
| 2003/0230427 | A1 * | 12/2003 | Gareis | 174/113 C |
| 2004/0055779 | A1 * | 3/2004 | Wiekhorst et al. | 174/117 AS |
| 2004/0256139 | A1 * | 12/2004 | Clark | 174/110 R |

FOREIGN PATENT DOCUMENTS

| | | | |
|---|---|---|---|
| GB | 725624 | * | 3/1955 |
| GB | 2063147 | * | 6/1981 |
| WO | WO 03/021607 A1 | | 3/2003 |
| WO | WO03021607 | | 3/2003 |

OTHER PUBLICATIONS

European Search Report; 3 pages; Dec. 12, 2005.

* cited by examiner

*Primary Examiner*—Chau N Nguyen

(57) ABSTRACT

A cable includes a round core having at least one twisted pair of insulated wires. A jacket surrounds the core, and the jacket includes at least one spline projecting inward from an inner surface of the jacket, wherein at least a portion of the twisted pair is positioned between the spline and a center of the core. The spline extends continuously on the inner surface of the jacket along a longitudinal axis of the core.

22 Claims, 3 Drawing Sheets

CABLE JACKET WITH INTERNAL SPLINES

BACKGROUND OF THE INVENTION

The invention relates generally to communications cable, cabling, and cordage, and more particularly, to twisted pair cabling with jackets surrounding a cable core.

Communication cables typically include a number of insulated wires therein. In order to minimize the problem of interference and random noise between the wires, the wires in the cable are generally twisted in pairs. At least one type of high-speed data communications cable includes a core having a filler material, a number of twisted pairs arranged around the filler material, and an insulative jacket surrounding the core. The twisted pairs are arranged in a manner to optimize performance in terms of impedance, attenuation, skew, and cross talk, among other things, for high-speed data and communication networks.

Certain types of cable have been found to meet frequency response specifications when tested at certain frequencies, according to, for example, the Telecommunications Industry Association and Electronics Industry Association category 5 and category 6 standards. When installed, however, the cables have not proven to consistently perform to their design standards. It is believed that manipulation and handling of the cable during manufacturing, distribution and installation sometimes causes relative movement between the cable jacket and the cable core. Relative movement of the cable jacket and the core can negatively impact cable performance, including, among other things, the "headroom" of the cable, or the differential between the frequency response of the cable at a test frequency and the maximum limit of the cable design. Thus, as the headroom is reduced, the ability of the cable to perform at higher frequencies is compromised. In the midst of increasing frequencies used in modern telecommunications and computer applications, the headroom of the cabling used in such a system is becoming increasingly important.

Some twisted pair cables are known to include separate compartments for each twisted pair in the cable. The compartments are formed through either the configuration of the jacket or with a separator structure encased by the jacket to prevent movement of the twisted pairs and to prevent crosstalk between the twisted pairs. See for example, U.S. Pat. Nos. 4,777,325 and 6,284,954. The jacket configurations and/or the separation structures, however, add additional cost and complexity to the cable, and can reduce the flexibility of the cable and hence make it more difficult to install. It would be desirable to preserve the headroom of a cable design for maximum performance of the cable in the field at a lower cost and without adversely affecting the flexibility of the cable.

BRIEF DESCRIPTION OF THE INVENTION

In an exemplary embodiment, a cable is provided which comprises a round core comprising at least one twisted pair of insulated wires. A jacket surrounds the core, and the jacket comprises at least one spline projecting inward from an inner surface of the jacket, wherein at least a portion of the twisted pair is positioned between the spline and a center of the core.

Optionally, the core comprises a filler and a plurality of twisted pairs arranged around the filler. The jacket comprises a plurality of splines projecting inward from an inner surface of the jacket and the splines extend continuously on the inner surface of the jacket. The splines extend along a longitudinal axis of the core and the splines are equally spaced from one another.

In another exemplary embodiment, a cable is provided. The cable comprises a core comprising a central core filler and a plurality of twisted pairs of insulated wires extending about the core filler, and a jacket surrounds the core. The jacket comprises a round inner surface and at least one spline projecting inward from the inner surface, wherein the at least one spline is adapted to prevent relative movement of the jacket and core without separating one of the plurality of twisted pairs from another of the plurality of twisted pairs.

According to another exemplary embodiment, a cable is provided. The cable comprises a round core comprising a central core filler and a plurality of twisted pairs of insulated wires extending about the core filler. A round jacket surrounds the core, and the jacket comprises an inner surface and a plurality of splines projecting inward from the inner surface. The plurality of splines are adapted to prevent relative movement of the jacket and core without separating the plurality of twisted pairs from one another.

DETAILED DESCRIPTION OF THE INVENTION

Figure 1:
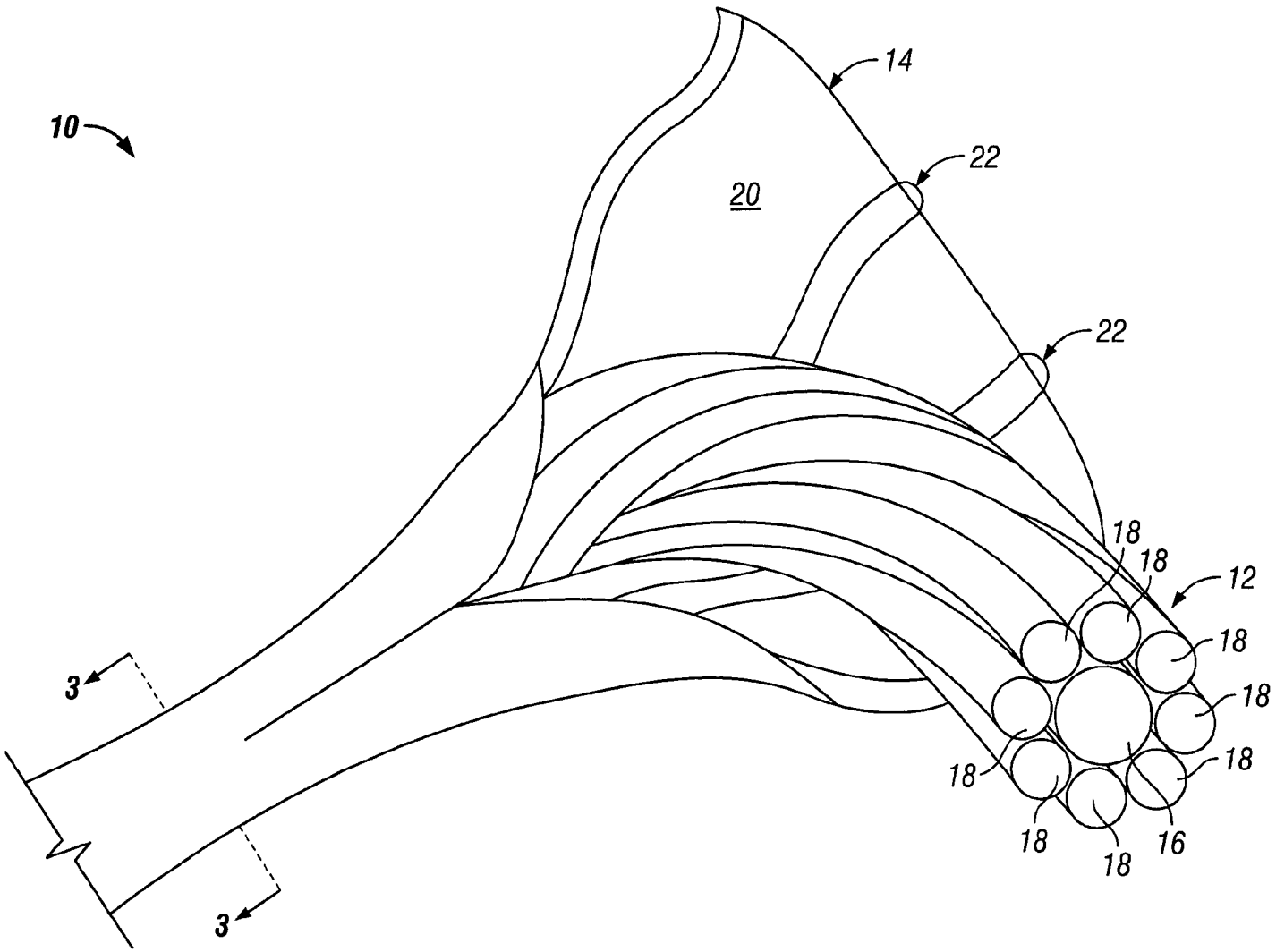
FIG. 1 illustrates an exemplary cable formed in accordance with an exemplary embodiment of the invention with the jacket partially peeled from the cable core.

FIG. 1 illustrates a cable 10 formed in accordance with an exemplary embodiment of the invention. For the reasons explained below, the cable 10 is configured to preserve and protect the headroom of the cable 10 (i.e., the differential between the frequency response of the cable at a test frequency and the maximum limit of the cable) during handling of the cable 10 to optimize the performance potential and consistency of the cable 10 in use in for, example, a high-speed communications or data system The cable 10 includes a core 12 and a jacket 14 surrounding the core 12. The core 12 includes a round filler 16 and a number of insulated wires 18 extending around the filler 16 and arranged in twisted pairs. In the illustrated embodiment, eight wires 18 are arranged in four pairs about the filler 16. It is appreciated, however, that greater or fewer numbers of wires 18 may be employed in greater or fewer numbers of pairs in alternative embodiments. The filler 16 and the wires 18 are fabricated from known materials familiar to those in the art. It is appreciated that filler 16 may be formed in various alternative shapes to the round or cylindrical shaped filler 16 illustrated in FIG. 1.

The jacket 14 surrounds the core 12 and is fabricated from a known insulative, i.e., nonconductive, material. The jacket 14 includes a smooth inner surface 20, and a number of ribs or splines 22 extending inward from the inner surface 22 toward the core 12. When the jacket 14 is in place over the core 12, the splines 22 maintain the core 12 is position relative to the jacket 14. That is, as the cable 10 is handled and manipulated, whether in manufacturing, distribution, or installation of the cable 10, the splines 22 secure the core 12 in a stationary position relative to the jacket 14. As such, the headroom of the cable 10 will not be influenced or affected by handling and installation of the cable 10.

Figure 2:
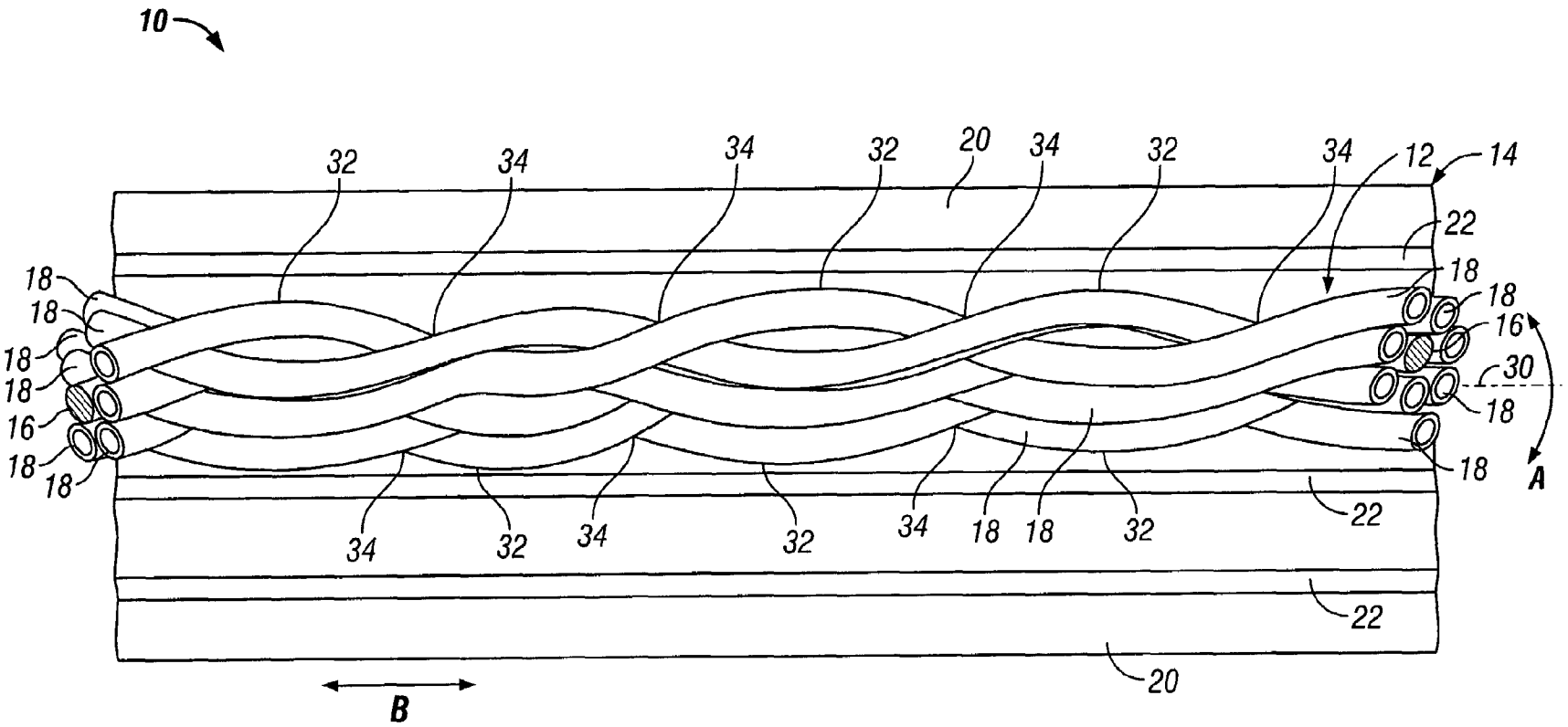
FIG. 2 is a perspective view of the cable core shown in FIGS. 1 and 2 with the jacket unwrapped.

FIG. 2 is a perspective view of the cable 10 with the jacket 14 unwrapped from the core 12. The core 12 extends generally along a longitudinal axis 30 of the cable 10, and the wires 18 in the core 12 are arranged with the filler 16 according to, for example, a left hand lay as those in the art will appreciate. It is appreciated that the filler 16 and the wires 18 may be alternatively arranged and configured in different embodiments. The lay length or technique of the wires 18 may be varied to achieve particular objectives or specifications of the cable 10 for a particular use.

The lay of the wires 18 in the twisted pairs forms a wavy outer profile wherein portions 32 of the outer surfaces of the wires 18 are located a greater radial distance from the longitudinal axis 30 than other portions 34 of the wires 18. The inner surface 20 of the jacket 14 contacts the portions 32 of the wires 18, and the splines 22 of the jacket 14 extend adjacent the portions 32 of some of the wires 18. Therefore, by positioning some of the portions 32 adjacent to or against the splines 22, the portions 32 of the wires 18 contact the splines 22 and prohibit the core 12 from moving or shifting relative to the jacket 14 as the cable 10 is handled. Alternatively, the splines 22 contact the jacket 14 and prevent the jacket 14 from moving or shifting relative to the core 12 as the cable 10 is handled. Rather, as one of the core 12 and the jacket 14 rotates about the longitudinal axis 30 in the direction of arrow A, the other of the core 12 and the jacket 14 rotates an equal amount about the longitudinal axis 30 and the relative position of the core 12 and the jacket 14 is preserved or maintained.

The splines 22 extend continuously along the length of the cable 10 and also extend substantially parallel to the longitudinal axis 30 and to one another. While longitudinally extending splines 22 have been found effective to prevent the core 12 from moving relative to the jacket 14, and vice-versa, it is understood that the splines 22 may be otherwise oriented in alternative embodiments. It is also contemplated that the splines 22 need not be continuous to substantially achieve the benefits of the instant invention. That is, the splines 22 may extend for less than an entire length of the cable 10 (i.e., in a direction of arrow B), and the splines 22 may include gaps along the length of the splines in various alternative embodiments.

Figure 3:
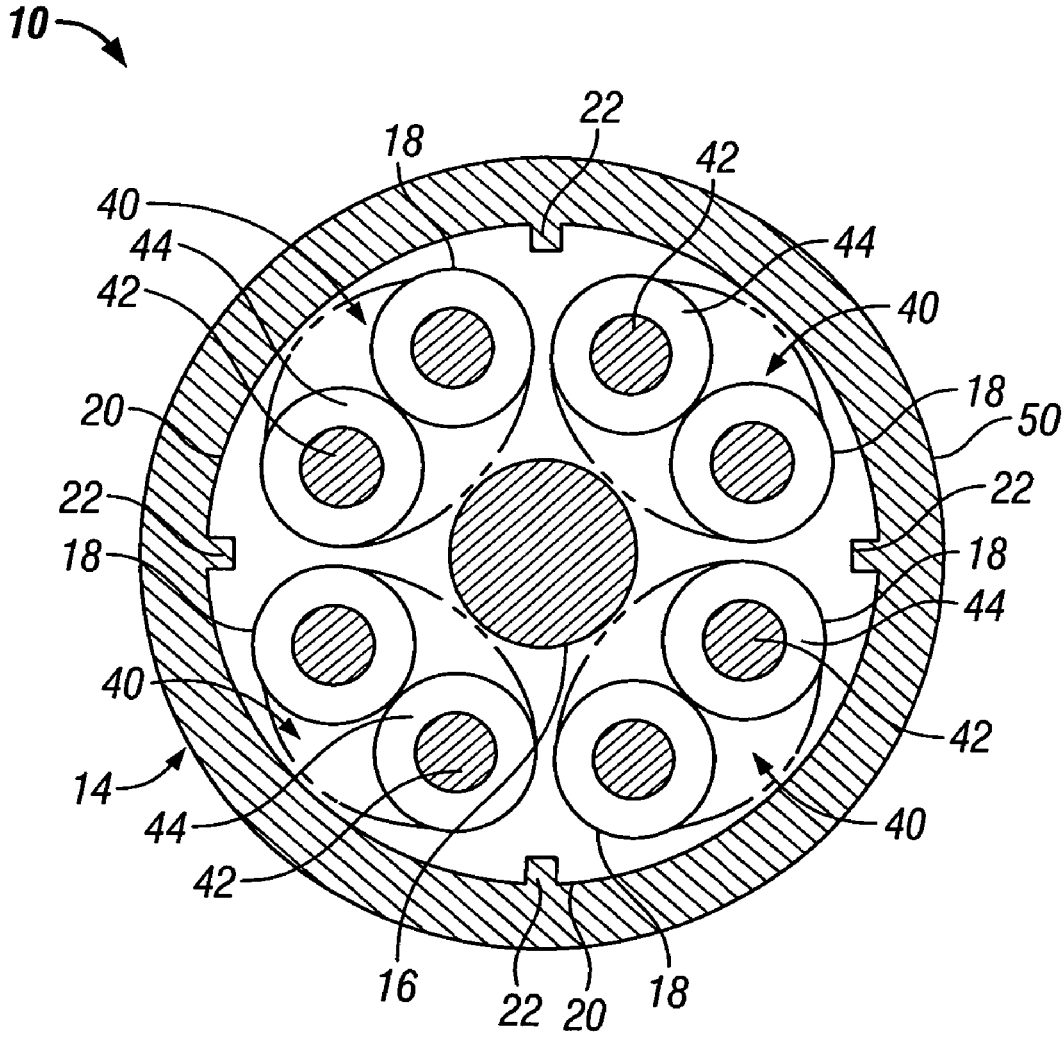
FIG. 3 is a cross sectional view of the cable shown in FIG. 1 along line 3-3.

FIG. 3 is a cross sectional view of the cable 10 illustrating the wires 18 arranged in four pairs 40 about the filler 16 which is centrally located in the cable 10. Each of the wires 18 includes a conductor 42 and insulation 44 surrounding the conductor 42. The conductor 42 and the insulation 44 of the wires 18 are fabricated from known materials and are dimensioned appropriately to carry electrical signals suitable to meet the needs of the communication or data system associated with the cable 10.

The splines 22 extend radially inward from the round or cylindrical inner surface 20 of the jacket 14 for a small distance sufficient to prevent relative movement of the core 12 and jacket 14, but insufficient to significantly affect the overall flexibility of the cable 10. Additionally, and as illustrated in FIG. 3, the wires 18 are located between the ends of the splines 22 and the filler 16 of the core 12. Thus, while the splines 22 prevent relative movement of the core 12 and the jacket 14, the splines 22 do not separate the wires 18 from one another.

An outer surface 50 of the jacket 14 is cylindrical or round, therefore minimizing material costs for the jacket 14. The jacket 14 may be extruded over the core 12 during the manufacture of the cable 10, although it is appreciated that the jacket 14 may be formed and/or extended over the core 12 according to other processes and techniques known in the art. The jacket 14 may further be formed into another shape in an alternative embodiment in lieu of a round jacket as illustrated in FIG. 3.

In the illustrated embodiment, four splines 22 are provided that are equally spaced from one another. Greater or fewer numbers of splines 22, however, may be employed in various alternative embodiments of the invention. While substantially rectangular splines 22 are illustrated in FIG. 3, other shapes of splines, including but not limited to triangular shaped splines, may be employed in different embodiments. Also, while radially extending splines 22 are illustrated, the invention is not considered so limited. Other arrangement of splines 22 may be provided which also achieve a stationary arrangement of the core 12 and the jacket 14.

The splines 22 are provided at relatively low cost to the cable 10 and prevent the core 12 and the jacket 14 from moving relative to one another. Associated degraded performance of the cable 10 is therefore avoided and the headroom of the cable is preserved for optimal signal transmission through the cable 10. The flexibility of the cable 10 is substantially unaffected while consistent performance and reliability for high frequency networking applications is achieved.

While the invention has been described in terms of various specific embodiments, those skilled in the art will recognize that the invention can be practiced with modification within the spirit and scope of the claims.

What is claimed is:

1. A cable comprising:

a core comprising at least one twisted pair of insulated wires; and a jacket surrounding said core, said jacket comprising at least one spline projecting inward from an inner surface of said jacket, wherein at least a portion of said twisted pair is positioned between said spline and a center of said core, wherein said at least one spline is in contact with said twisted pair to prevent relative movement of said jacket with respect to said twisted pair.

2. The cable of claim 1 wherein said core comprises a filler and said at least one twisted pairs comprises a plurality of twisted pairs arranged around said filler.

3. The cable of claim 1 wherein said at least one spline comprises a plurality of splines projecting inward from the inner surface of said jacket.

4. The cable of claim 1 wherein said spine is continuously extending on said inner surface of said jacket.

5. The cable of claim 1 wherein said spline extends along a longitudinal axis of said core.

6. The cable of claim 1 wherein said jacket is extruded over said core.

7. The cable of claim 1 wherein said at least one spline comprises at least two splines projecting inward from the inner surface of said jacket, said splines equally spaced from one another.

8. The cable of claim 1 wherein said al least one splice comprises four splices projecting inward from an inner surface of said jacket.

9. The cable of claim 1 wherein said spline projects radially inwardly from said inner surface of said jacket.

10. A cable comprising:

a core comprising a plurality of twisted pairs of insulated wires; and a jacket surrounding said core, said jacket comprising a round inner suffice and at least one spline projecting inward from said inner surface, wherein said at least one spline is in contact with at least one of said twisted pairs to prevent relative movement of said jacket with respect to said at least one said twisted pairs without separating one of said plurality of twisted pairs from another of said plurality of twisted pairs.

11. The cable of claim 10 wherein said core comprises a round central core filler.

12. The cable of claim 10 wherein said at least one spline comprises a plurality of splines projecting inward from an inner surface of said jacket.

13. The cable of claim 10 wherein said spline is continuously extending on said inner surface of said jacket.

14. The cable of claim 10 wherein said spline extends along a longitudinal axis of said core.

15. The cable of claim 10 wherein said jacket is extruded over said core.

16. The cable of claim 10 wherein said at least one spline comprises at least two splines projecting inward from an inner surface of said jacket, said splines equally spaced from one another.

17. The cable of claim 10 wherein said at least one spline comprises four splines projecting inward from an inner surface of said jacket.

18. The cable of claim 10 wherein said spline projects radially inwardly from said inner surface of said jacket.

19. The cable of claim 10, wherein said core comprises a filler and said plurality of twisted pairs are arranged about said filler.

20. A cable comprising:

a core comprising a plurality of twisted pairs of insulated wires; and a jacket surrounding said core, said jacket comprising an inner surface and a plurality of splines projecting inward from said inner surface, wherein said plurality of splines are in contact with said plurality of twisted pairs to prevent relative movement of said jacket with respect to said plurality of twisted pairs without separating said plurality of twisted pairs from one another.

21. The cable of c1aim 20, wherein said plurality of splines are equally spaced about said core.

22. The cable of claim 20, wherein said core comprises a filler and said plurality of twisted pairs are arranged about said filler.

* * * * *